US012800232B2

(12) United States Patent
Li et al.

(10) Patent No.: US 12,800,232 B2
(45) Date of Patent: Nov. 17, 2026

(54) HEAT EXCHANGER

(71) Applicant: ZHEJIANG SANHUA AUTOMOTIVE COMPONENTS CO., LTD., Hangzhou (CN)

(72) Inventors: Hua Li, Hangzhou (CN); Shijie Shen, Hangzhou (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 439 days.

(21) Appl. No.: 18/552,920

(22) PCT Filed: Mar. 30, 2022

(86) PCT No.: PCT/CN2022/083894
§ 371 (c)(1),
(2) Date: Sep. 28, 2023

(87) PCT Pub. No.: WO2022/206792
PCT Pub. Date: Oct. 6, 2022

(65) Prior Publication Data

US 2024/0175637 A1 May 30, 2024

(30) Foreign Application Priority Data

Mar. 30, 2021 (CN) ..... 202110338873.3

(51) Int. Cl.
*F28D 9/00* (2006.01)
*F28F 3/08* (2006.01)
*F28F 3/04* (2006.01)

(52) U.S. Cl.
CPC ..... *F28D 9/0075* (2013.01); *F28F 3/083* (2013.01); *F28D 9/0037* (2013.01); *F28D 9/005* (2013.01); *F28F 3/046* (2013.01); *F28F 2225/00* (2013.01)

(58) Field of Classification Search
CPC ..... F28D 9/0037; F28D 9/0075; F28D 9/005; F28F 3/046; F28F 2225/00
See application file for complete search history.

(56) References Cited

U.S. PATENT DOCUMENTS 2,872,165 A * 2/1959 Fritz ..... F28F 3/046 165/166
3,783,090 A * 1/1974 Stadmark ..... F28F 3/04 165/166

(Continued)

FOREIGN PATENT DOCUMENTS

CN 102027306 A * 4/2011 ..... F28F 3/046
CN 201867113 U 6/2011

(Continued)

OTHER PUBLICATIONS

Translation of CN102027306A named Translation-CN102027306A (Year: 2011).*

(Continued)

*Primary Examiner* — Paul Alvare
(74) *Attorney, Agent, or Firm* — Yue (Robert) Xu; Apex Attorneys at Law, LLP

(57) ABSTRACT

A heat exchanger includes a heat exchange plate, and the heat exchange plate includes a base plate, and a first protrusion and a second protrusion protruding towards a first direction. The back surfaces of the first protrusion and the second protrusion form a first groove and a second groove. The maximum width of the orthographic projection of the first groove on a second side surface of the base plate is λ1, and the maximum width of the orthographic projection of the second groove on the second side surface of the base plate is λ2, the depths of the first groove and the second groove relative to the second side surface of the base plate are Dp1 and Dp2 respectively, the thicknesses of the protrusion tops of the first protrusion and the second protrusion (Continued)

are h1 and h2 respectively, where −0.05 mm≤(h1+DP1)−(h2+DP2)≤0.05 mm, and DP1>DP2, λ1<λ2.

20 Claims, 8 Drawing Sheets

(56) References Cited

U.S. PATENT DOCUMENTS

| | | | | |
|---|---|---|---|---|
| 10,274,261 | B2 * | 4/2019 | Wei | F28F 3/042 |
| 10,775,108 | B2 * | 9/2020 | Andersson | F28F 3/046 |
| 2004/0177668 | A1 * | 9/2004 | Sagasser | F28D 9/005 72/326 |
| 2012/0325434 | A1 * | 12/2012 | Blomgren | F28F 3/046 165/104.19 |
| 2013/0087318 | A1 | 4/2013 | Nakano et al. | |
| 2014/0008047 | A1 * | 1/2014 | Ito | F28F 3/046 165/166 |
| 2017/0219296 | A1 * | 8/2017 | Wei | F28D 9/00 |
| 2019/0285363 | A1 * | 9/2019 | Ruiz | B33Y 80/00 |
| 2019/0376749 | A1 * | 12/2019 | Zhang | F28D 9/00 |
| 2023/0041265 | A1 * | 2/2023 | Andersson | F25B 39/022 |

FOREIGN PATENT DOCUMENTS

| | | | |
|---|---|---|---|
| CN | 103424014 | A | 12/2013 |
| CN | 106197093 | A | 12/2016 |
| CN | 206410590 | U | 8/2017 |
| CN | 110469869 | A | 11/2019 |
| CN | 110645818 | A | 1/2020 |
| CN | 210718795 | U | 6/2020 |
| JP | 2008121956 | A | 5/2008 |
| WO | 2021023031 | A1 | 2/2021 |

OTHER PUBLICATIONS

International Search Report for PCT/CN2022/083894 mailed Jun. 6, 2022, ISA/CN.

* cited by examiner

HEAT EXCHANGER

The present application is the national phase of International Application No. PCT/CN2022/083894, titled "HEAT EXCHANGER", filed on Mar. 30, 2022, which claims the priority to Chinese Patent Application No. 202110338873.3, titled "HEAT EXCHANGER", filed on Mar. 30, 2021 with the China National Intellectual Property Administration, the entire disclosures thereof are incorporated herein by reference.

FIELD

The present application relates to the technical field of heat exchange, and in particular to a heat exchanger.

BACKGROUND

A heat exchanger in the conventional technology includes a plurality of heat exchange plates arranged in a stacked manner, the heat exchange plate is provided with protrusions to increase the contact area between the heat exchange plate and the heat exchange fluid, and to disturb the heat exchange fluid to improve heat exchange performance. For a compact plate heat exchanger, especially in application scenarios such as automobiles or energy-efficient refrigeration equipment, a flow-channel size of the heat exchanger is significantly reduced, from a traditional hydraulic diameter of 3 to 5 mm, to a hydraulic diameter below 3 mm, even 2 mm or less. In such a situation, higher requirements are put forward for the manufacturing accuracy of the heat exchange plate, especially for plate molds, stamping technology, brazing technology, etc., the technical difficulty is significantly increased compared with related applications in traditional industries. The heat exchange plate usually adopts a full profiling mold manufacturing technology, that is, the mold is manufactured by complete profile modeling according to the structure of the heat exchange plate. In the case that the heat exchange plate is provided with two or more different structures of protrusions, it is easy to cause the heights of tops of some protrusions to be different, and pseudo soldering is prone to occur at a position with a lower height of the top of the protrusion, which ultimately affects the heat exchange performance and the reliability of a product.

SUMMARY

The object of the present application is to provide a heat exchanger, which reduces height differences of tops of protrusions of a heat exchange plate, to reduce pseudo soldering of the heat exchanger.

A heat exchanger is provided according to the embodiments of the present application. The heat exchanger includes multiple heat exchange plates arranged in a stacked manner, each of the heat exchange plates includes a base plate, a first protrusion and a second protrusion, a direction perpendicular to the base plate is defined as a first direction, both the first protrusion and the second protrusion protrude towards the first direction, a first groove is formed on a back side of the first protrusion, a second groove is formed on a back side of the second protrusion, the base plate includes two side surfaces, a side surface facing the first direction is defined as a first side surface, and a side surface facing away from the first direction is defined as a second side surface;

a maximum width of an orthographic projection of the first groove on a plane where the second side surface of the base plate is located is defined as $\lambda 1$, a maximum width of an orthographic projection of the second groove on the plane where the second side surface of the base plate is located is defined as $\lambda 2$, a depth of the first groove relative to the second side surface of the base plate is defined as Dp1, a depth of the second groove relative to the second side surface of the base plate is defined as Dp2, a thickness of a protrusion top of the first protrusion is defined as h1, a thickness of a protrusion top of the second protrusion is defined as h2, where $-0.05\ \text{mm} \leq (h1+Dp1)-(h2+Dp2) \leq 0.05\ \text{mm}$, $Dp1>Dp2$, and $\lambda 1<\lambda 2$.

The heat exchange plate has the first protrusion and the second protrusion, the first groove is formed on the back side of the first protrusion, the second groove is formed on the back side of the second protrusion, $-0.05\ \text{mm} \leq (h1+Dp1)-(h2+Dp2) \leq 0.05\ \text{mm}$ is met, $Dp1>Dp2$, and $\lambda 1<\lambda 2$. Since $\lambda 1<\lambda 2$, the deformation of the heat exchange plate in the area where the first protrusion is located is greater than the deformation of the heat exchange plate in the area where the second protrusion is located, which easily causes the thinning degree of the material of the top of the first protrusion to be greater than the thinning degree of the material of the top of the second protrusion. That is, a thickness of the top of the first protrusion is smaller than a thickness of the top of the second protrusion, which easily causes the top of the first protrusion to be lower than the top of the second protrusion. By increasing the depth Dp1 of the first groove, that is, by making the depth Dp1 of the first groove greater than the depth Dp2 of the second groove, the thinned amount of the top of the first protrusion is compensated through the depth of the first groove, which reduces the height difference between the top of the first protrusion and the top of the second protrusion, and thereby reducing the pseudo soldering of the heat exchanger.

DETAILED DESCRIPTION OF THE EMBODIMENTS

Figure 1:
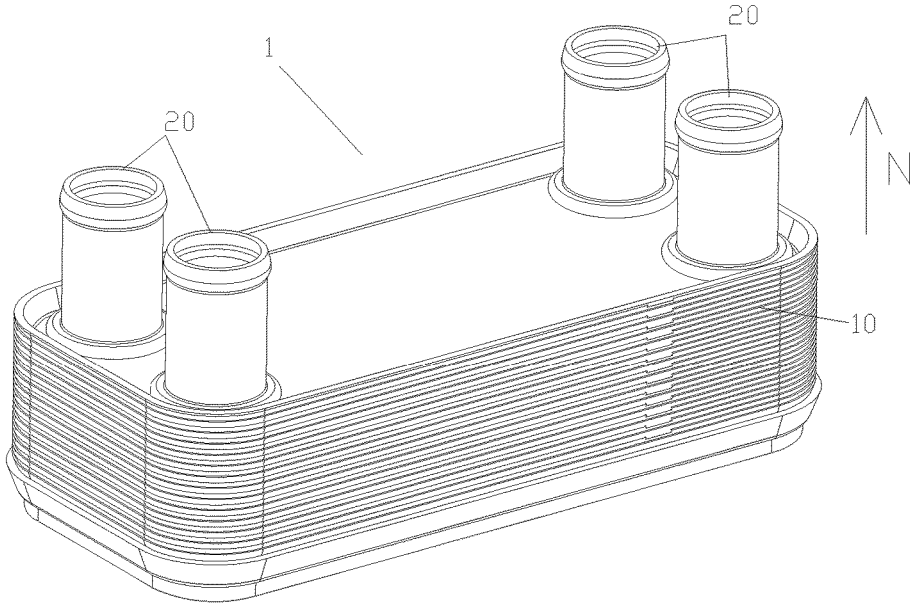
FIG. 1 is a three-dimensional view showing the structure of a heat exchanger according to the present application.

Referring to FIGS. 1 to 16, a heat exchanger 1 is provided according to embodiments of the present application. The heat exchanger 1 includes a plurality of heat exchange plates 10 arranged in a stacked manner, a fluid channel is provided between adjacent heat exchange plates 10, and other components such as fins may be arranged in the fluid channel. The heat exchanger 1 is also provided with a connection tube 20 in communication with the fluid channel. The heat exchange plate 10 includes a base plate 11, a first protrusion 12, and a second protrusion 13. A direction perpendicular to the base plate 11 is defined as a first direction, and the first direction is the direction N in FIGS. 1, 5 and 8. The first protrusion 12 and the second protrusion 13 protrude towards a same direction, and both protrude towards the first direction N. The base plate 11 includes a first side surface 111 close to the first protrusion 12 and the second protrusion 13, and a second side surface 112 away from the first protrusion 12 and the second protrusion 13. A first groove 14 is formed on a back side of the first protrusion 12, and a second groove 15 is formed on a back side of the second protrusion 13. A maximum width of an orthographic projection of the first groove 14 on a plane where the second side surface 112 of the base plate 11 is located is $\lambda 1$, a maximum width of an orthographic projection of the second groove 15 on the plane where the second side surface 112 of the base plate 11 is located is $\lambda 2$, a depth of the first groove 14 relative to the second side surface 112 of the base plate 11 is Dp1, a depth of the second groove 15 relative to the second side surface 112 of the base plate 11 is Dp2, where $\lambda 1/Dp1<\lambda 2/Dp2$, and $Dp1>Dp2$.

In a case that the heat exchange plate 10 has two or more different protrusions, that is, the heat exchange plate 10 has at least the first protrusion 12 and the second protrusion 13, and the first protrusion 12 and the second protrusion 13 meet $\lambda 1/Dp1<\lambda 2/Dp2$. In this case, the maximum width of the orthographic projection of the first groove 14, located on the back side of the first protrusion 12, on the plane where the second side surface 112 of the base plate 11 is located is smaller than the maximum width of the orthographic projection of the second groove 15, located on the back side of the second protrusion 13, on the plane where the second side surface 112 of the base plate 11 is located, that is, $\lambda 1<\lambda 2$, and the depth of the first groove 14 relative to the second side surface 112 of the base plate 11 is greater than the depth of the second groove 15 relative to the second side surface 112 of the base plate 11. When processing the protrusions of the heat exchange plate 10, since $\lambda 1<\lambda 2$, the deformation of the heat exchange plate 10 in an area where the first protrusion 12 is located is greater than the deformation of the heat exchange plate 10 in an area where the second protrusion 13 is located, which easily causes the thinning degree of the material of the top of the first protrusion 12 to be greater than the thinning degree of the material of the top of the second protrusion 13. That is, a thickness of the top of the first protrusion 12 is smaller than a thickness of the top of the second protrusion 13, which easily causes the top of the first protrusion 12 to be lower than the top of the second protrusion 13. By increasing the depth Dp1 of the first groove 14, that is, by making the depth Dp1 of the first groove 14 greater than the depth Dp2 of the second groove 15, the thinned amount of the top of the first protrusion 12 is compensated through the depth of the first groove 14, which reduces the height difference between the top of the first protrusion 12 and the top of the second protrusion 13, and thereby reducing pseudo soldering of the heat exchanger 1. In addition, this parameter relationship between the first protrusion 12 and the second protrusion 13 makes the heat exchanger 1 have better heat exchange performance, structural molding characteristics of the heat exchange plate 10 should also be taken in to account in design for manufacturing. The difference in material molding is considered in obtaining a structure of the heat exchange plate 10 which facilitates heat exchange, and the heat exchange requirement and manufacturing characteristics of the heat exchanger 1 are satisfied at the same time.

The base plate refers to the part of the heat exchange plate without protrusions or grooves, and may be a flat part around a corner hole of the heat exchange plate or a flat part between adjacent protrusions or grooves.

Figure 14:
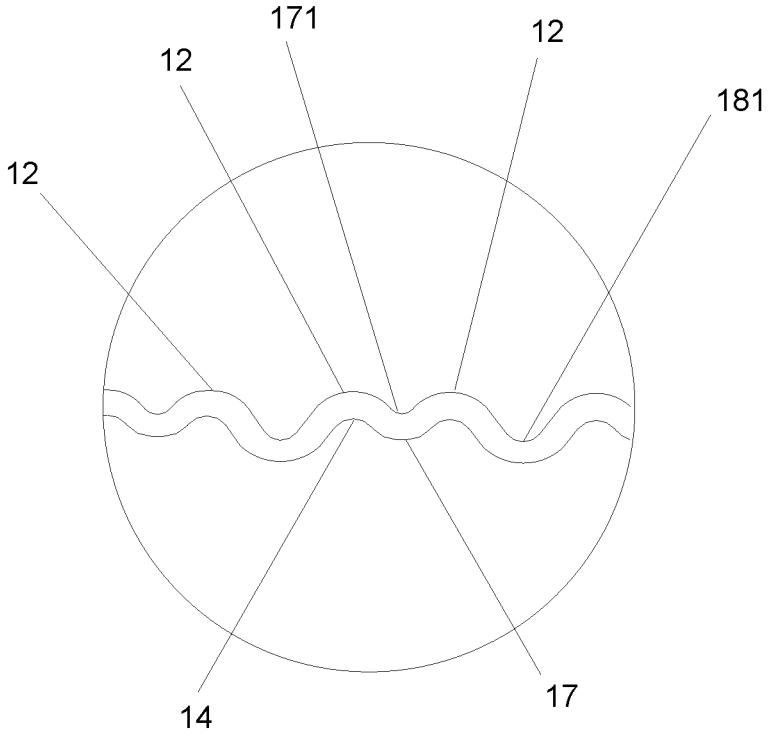
FIG. 14 is a schematic view of a partial structure of a heat exchange plate according to the present application.
Figure 15:
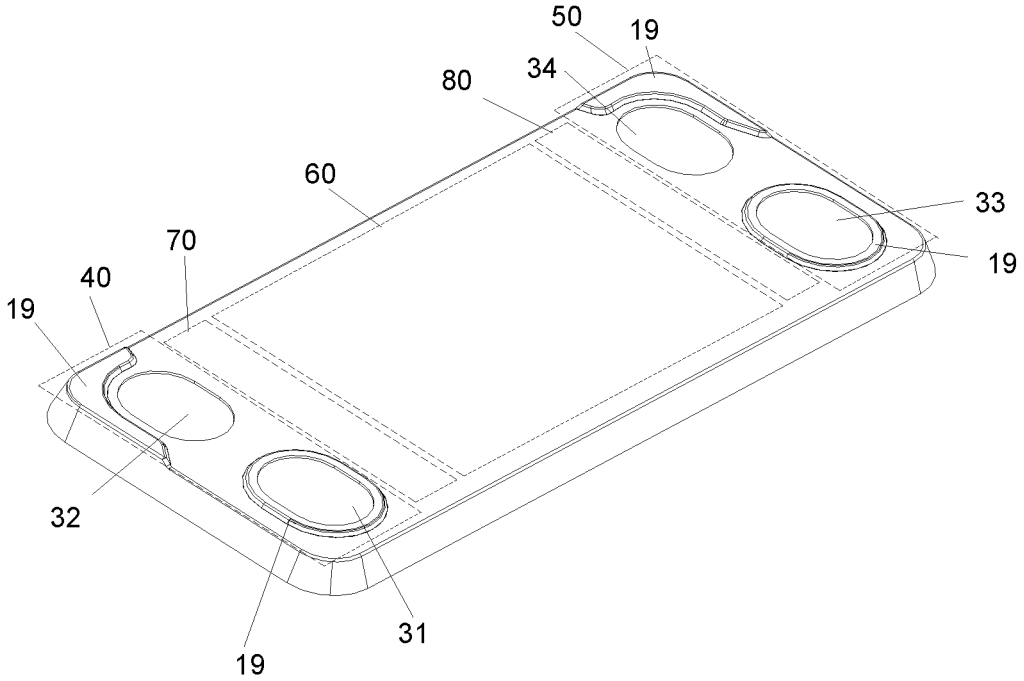
FIG. 15 is a view showing distribution of a heat exchange area and corner hole areas of the heat exchange plate according to the present application.

In some embodiments, as shown in FIG. 2 to 15, the first protrusions 12 are provided in a middle part of the heat exchange plate 10 in a length direction, and the second protrusions 13 are close to an end of the heat exchange plate 10 in the length direction. Specifically, as shown in FIG. 15, the heat exchange plate 10 includes a first corner hole area 40, a second corner hole area 50, and a heat exchange area 60. The heat exchange plate 10 includes a first end and a second end along the length direction of the heat exchange plate 10, the first corner hole area 40 is close to the first end of the heat exchange plate 10, the second corner hole area 50 is close to the second end of the heat exchange plate 10, and the heat exchange area 60 is located between the first corner hole area 40 and the second corner hole area 50. The first protrusions 12 are located in the heat exchange area 60, the second protrusions 13 are located in the first corner hole area 40 and/or the second corner hole area 50. The first protrusions 12 are arranged to be located in the heat exchange area 60, since $\lambda 1/Dp1<\lambda 2/Dp2$, and $Dp1>Dp2$, greater heat exchange area and more detailed heat exchange space and protruding structure are provided through superior design for material stretching and molding. That is, $\lambda 1<\lambda 2$, the heat exchange performance of the heat exchange area 60 is preferentially ensured. In addition, the second protrusions 13 are arranged to be located in the first corner hole area 40 and/or the second corner hole area 50, so as to meet the fluid distribution of the first corner hole area 40 and the second corner hole area 50, and ensure the wall thickness of the fluid channel in the areas and the strength of the welded structure.

Figure 2:
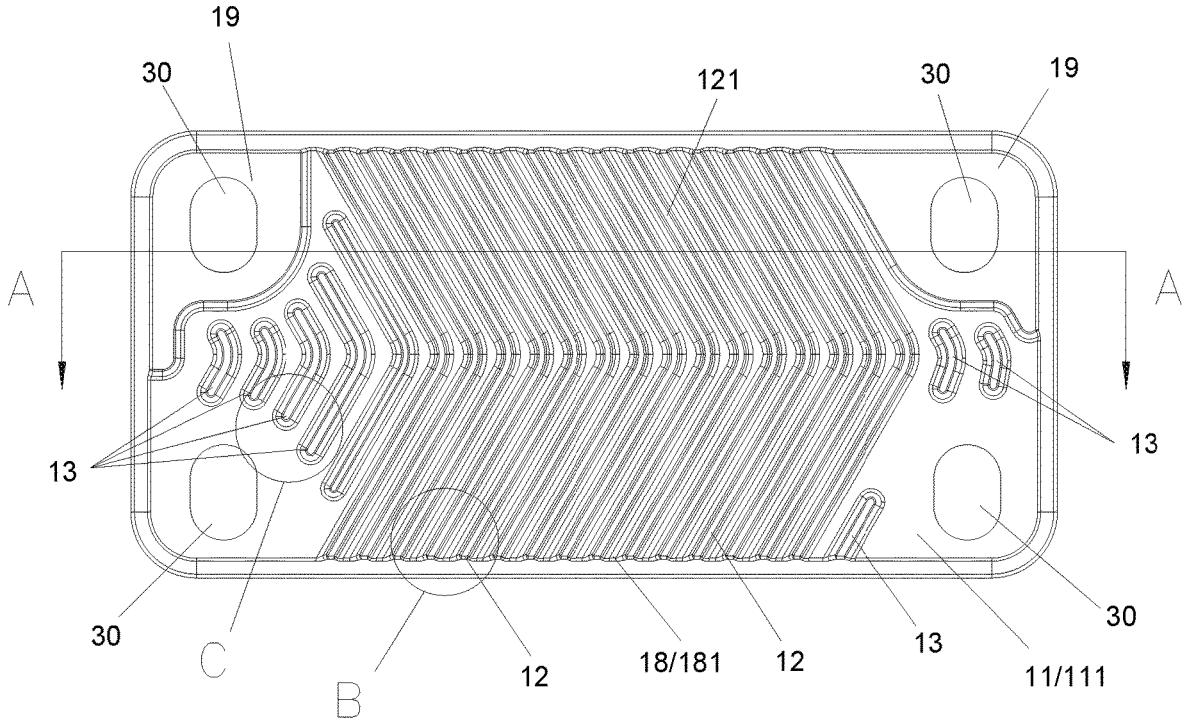
FIG. 2 is a schematic view showing the structure of a heat exchange plate according to an embodiment of the present application.
Figure 3:
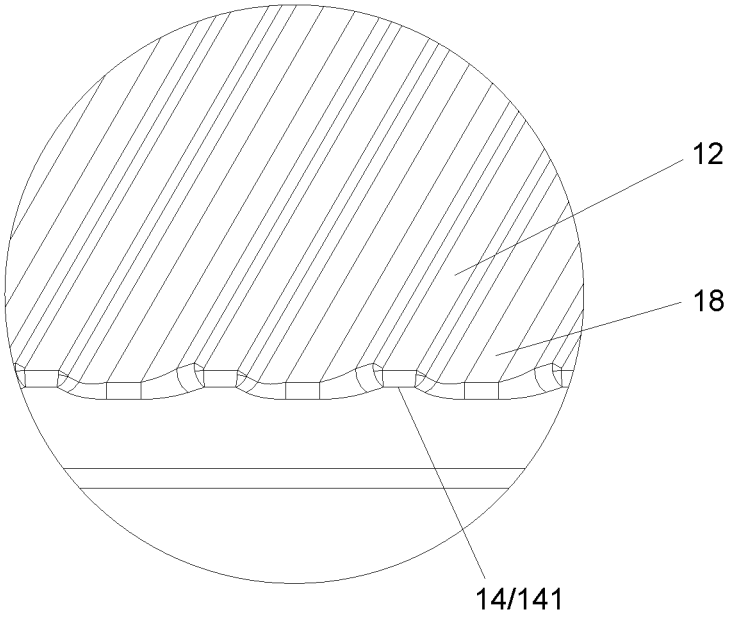
FIG. 3 is a schematic view showing the structure of an enlarged portion B in FIG. 2.
Figure 4:
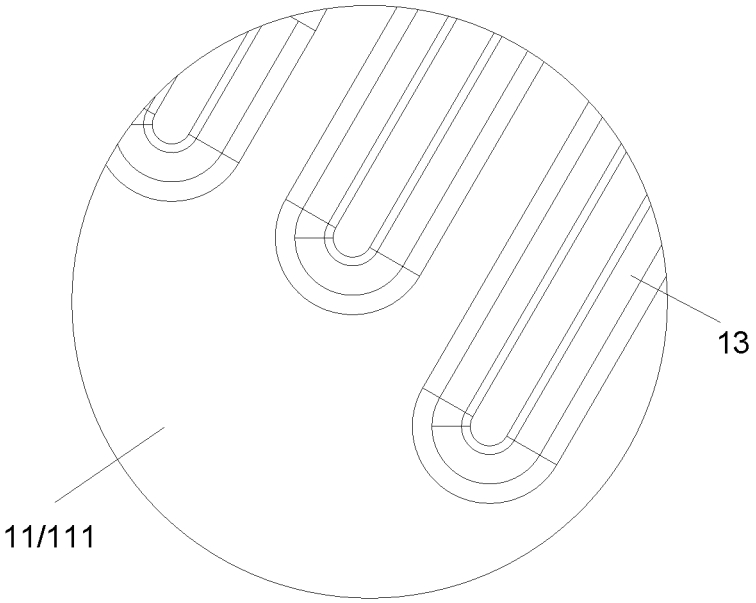
FIG. 4 is a schematic view showing the structure of an enlarged portion C in FIG. 2.
Figure 8:
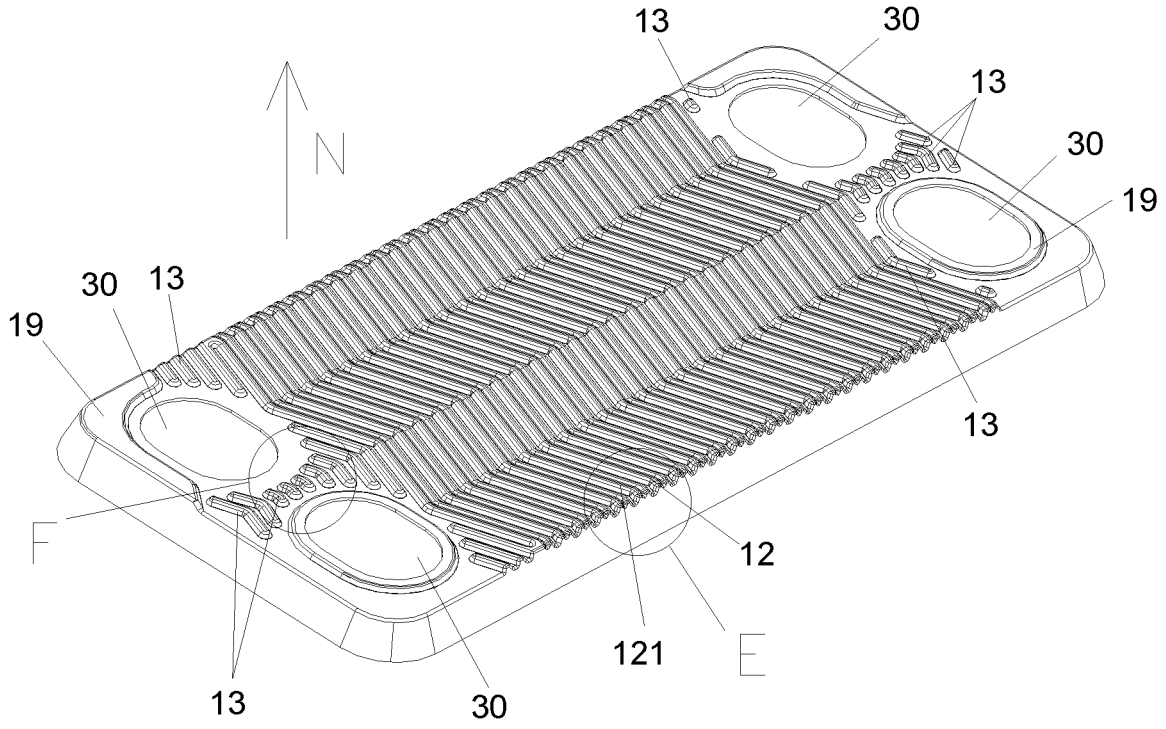
FIG. 8 is a schematic view showing the structure of a heat exchange plate according to another embodiment of the present application.

In some specific embodiments, as shown in FIGS. 8 and 15, the first corner hole area 40 and the second corner hole area 50 are each provided with multiple corner holes 30, along a width direction of the heat exchange plate 10, a first corner hole 31 and a second corner hole 32 are provided in the first corner hole area 40, and a third corner hole 33 and a fourth corner hole 34 are provided in the second corner hole area 50. The first corner hole 31 and the third corner hole 33 are provided on a same side of the heat exchange plate 10, and the second corner hole 32 and the fourth corner hole 34 are provided on the other side of the heat exchange plate 10. The second protrusions 13 may be provided between the first corner hole 31 and the second corner hole 32, and the second protrusions 13 may be provided between the third corner hole 33 and the fourth corner hole 34, where, second protrusions 13 may be provided in only one of the above two corner hole areas, or may be provided in both the two corner hole areas. In addition, as shown in FIGS. 2 and 8, a first flow guide area 70 may be provided between the first corner hole area 40 and the heat exchange area 60, a second flow guide area 80 may be provided between the second corner hole area 50 and the heat exchange area 60, and the second protrusions 13 are located in the first flow guide area 70 and/or the second flow guide area 80 to ensure the distribution of the fluid. Of course, the heat exchange plate 10 may not be provided with a flow guide area, and the second protrusions 13 may be provided only in the corner hole area.

Figure 5:
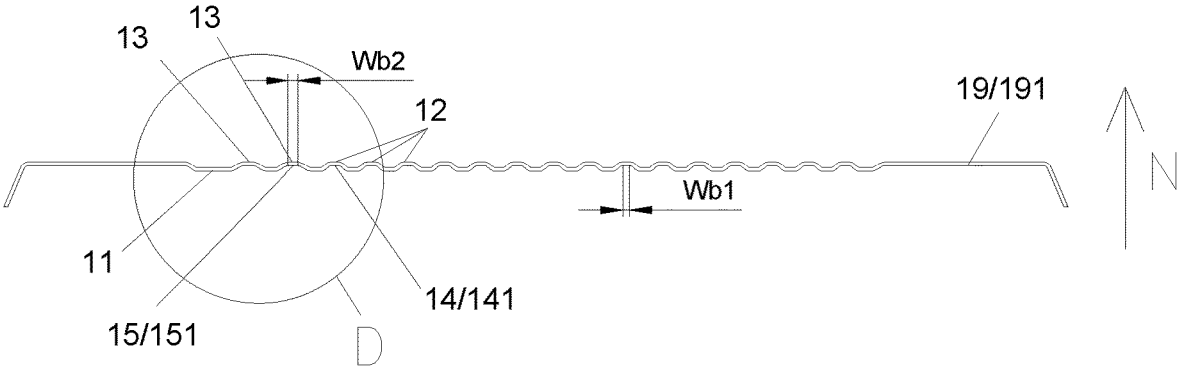
FIG. 5 is a schematic view showing the structure of a cross-section taken along line A-A in FIG. 2.
Figure 11:
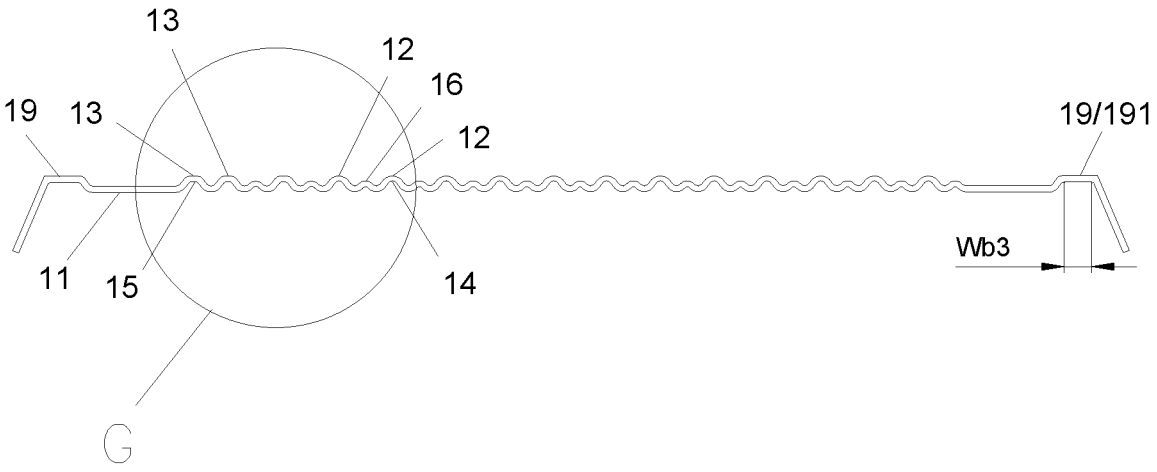
FIG. 11 is a schematic view showing the structure of a cross-section of the heat exchange plate according to the another embodiment of the present application.

As shown in FIG. 8, the heat exchange plate 10 is further provided with multiple protruding parts 19 protruding towards the first direction. The protruding parts 19 are respectively arranged around an edge of the first corner hole 31 and an edge of the third corner hole 33. The first corner hole 31 and the third corner hole 33 are each arranged at a top of the corresponding protruding part 19. In addition, the protruding parts 19 may also be arranged at other positions, for example, the protruding parts 19 are arranged at outer peripheries of the second corner hole 32 and the fourth corner hole 34, predetermined distances are respectively provided between the second corner hole 32 and the corresponding protruding part 19 and between the fourth corner hole 34 and the corresponding protruding part 19. A back side of a protrusion top of the first protrusion 12 has a first flat part 141, a back side of a protrusion top of the second protrusion 13 has a second flat part 151, and a back side of the top of the protrusion 19 has a third flat part 191. As shown in FIG. 5, a width of the first flat part 141 is Wb1, and a width of the second flat part 151 is Wb2, as shown in FIG. 11, a width of the third flat part 191 is Wb3, where the width Wb1 of the first flat part 141, the width Wb2 of the second flat part 151, and the width Wb3 of the third flat part 191 meet the following relationship: $Wb1 \leq Wb2 \leq Wb3$. The width Wb1 of the first flat part 141, the width Wb2 of the second flat part 151, and the width Wb3 of the third flat part 191 do not include chamfer parts. By adjusting the relationship among the widths of the first flat part 151, the second flat part 152, and the third flat part 153, the width of the third flat part 153 is relatively large to ensure the strength of the heat exchange plate 10, the widths of the first flat part 151 and the second flat part 152 are relatively small to ensure the heat exchange effect of the corresponding areas. Specifically, Wb1 is preferably not greater than 1.5 mm, and Wb3 is preferably not less than 2 mm. With the flat parts, the contact areas between the heat exchange plates 10 or between the heat exchange plate 10 and the fins are increased, and the overall strength of the heat exchanger 1 is enhanced.

The first corner hole 31 and the fourth corner hole 34 may be provided on a same side of the heat exchange plate 10, and the second corner hole 32 and the triangular hole 33 are provided on the other side of the heat exchange plate 10, so as to realize diagonal flow of the heat exchange fluid, that is, an inlet and an outlet of the fluid channel are located on different sides of the heat exchange plate.

In some specific embodiments, the first protrusions 12 may be wave-shaped protrusions, the multiple wave-shaped protrusions are arranged along the length direction of the heat exchange plate 10, and a recess 18 is formed between two adjacent wave-shaped protrusions. Specifically, as shown in FIG. 2, each of the first protrusions 12 is a single herringbone wave, where the single herringbone wave refers to that the first protrusion 12 includes two extension sections 121 between which an included angle is provided. Each of the extension sections 121 is arranged obliquely relative to the length direction of the heat exchange plate 10. The two extension sections 121 may be arranged symmetrically or asymmetrically along the width direction of the heat exchange plate 10. Part of the extension section 121 may extend along the length direction of the heat exchange plate 10. A first recess 181 is formed between adjacent wave-shaped protrusions. A part of the second protrusions 13 are wave-shaped protrusions, and another part of the second protrusions 13 are strip-shaped protrusions.

Figure 12:
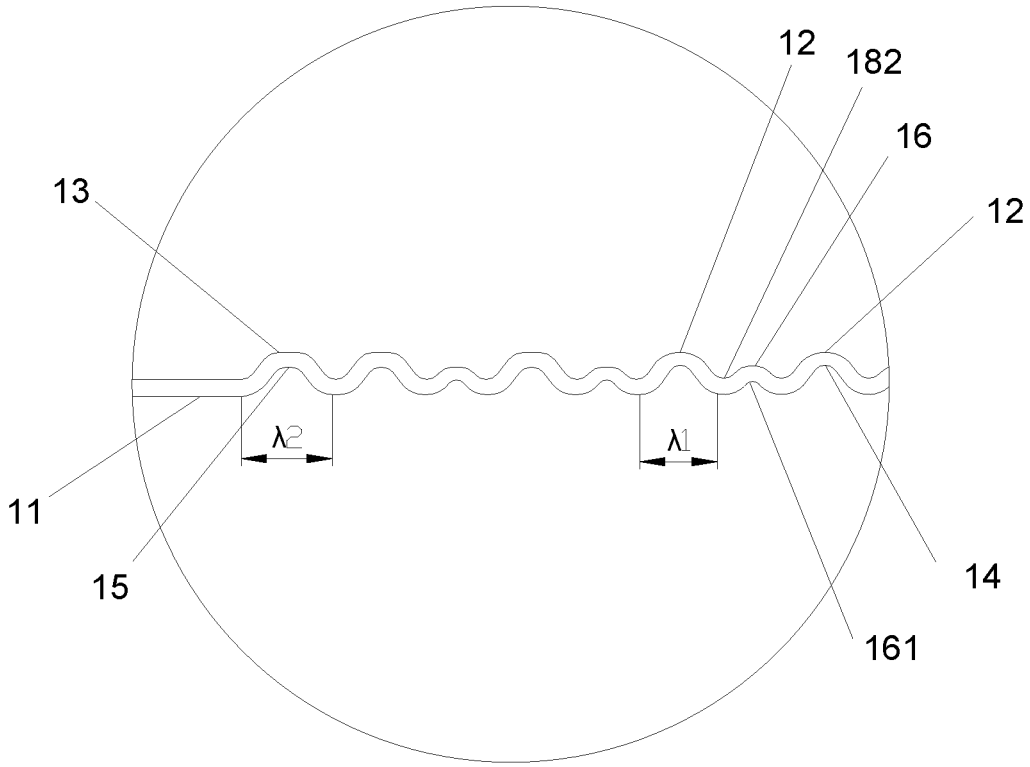
FIG. 12 is a schematic view showing the structure of an enlarged portion G in FIG. 11.

In some embodiments, as shown in FIGS. 8 to 15, the first protrusions 12 are wave-shaped protrusions. Specifically, each of the first protrusions 12 is a multi-herringbone wave, and the multi-herringbone wave refers to that the first protrusion 12 includes multiple extension sections 121 arranged in a manner that an included angle is provided between adjacent extension sections 121. Each of the extension section 121 is arranged obliquely relative to the length direction of the heat exchange plate 10, and the number of the extension sections 121 is greater than two. As shown in FIGS. 11 and 12, a third protrusion 16 protruding towards the first direction is provided between at least part of pairs of adjacent first protrusions 12, and a third groove 161 is formed on a back side of the third protrusion 16. A height of the third protrusion 16 relative to the first side surface 111 of the base plate 11 is smaller than a height of the first protrusion 12 relative to the first side surface 111 of the base plate 11. A second recess 182 is formed between adjacent first protrusion 12 and third protrusion 16. With the third protrusion 16, an asymmetric structure of the heat exchange plate 10 is realized, that is, adjacent fluid channels have different flow areas, different flow turbulence effects of the fluid channels are realized, and the heat exchange performance of the heat exchanger is improved through the more complex protruding structure.

Figure 9:
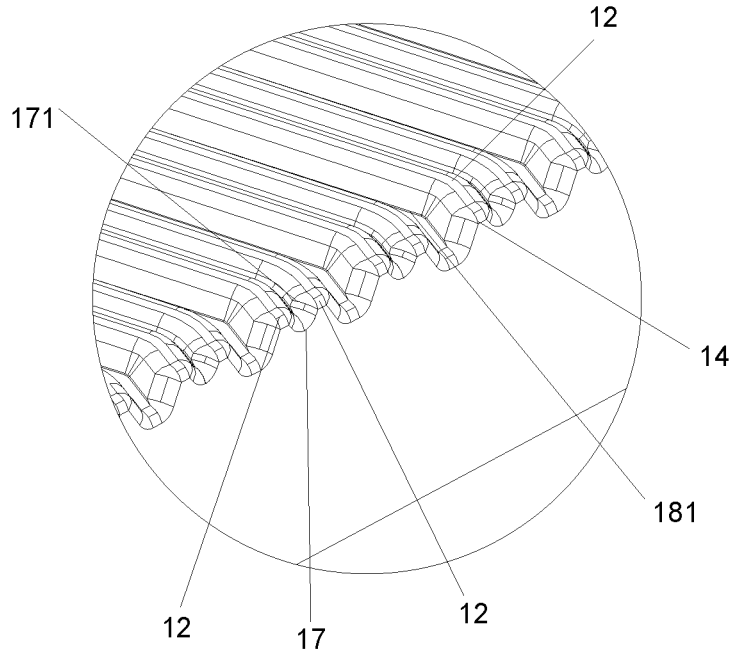
FIG. 9 is a schematic view showing the structure of an enlarged portion E in FIG. 8.
Figure 10:
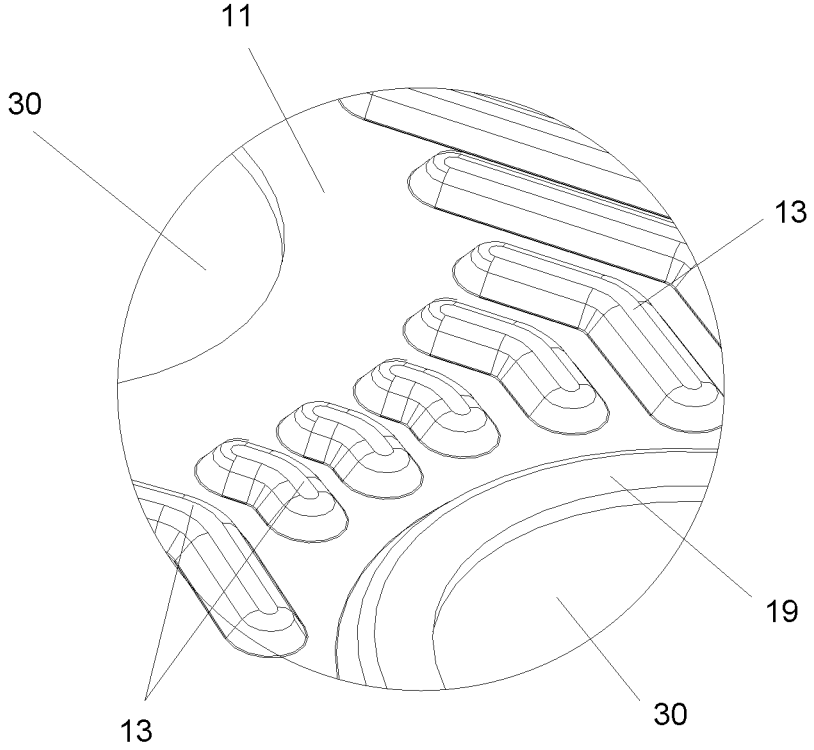
FIG. 10 is a schematic view showing the structure of an enlarged portion F in FIG. 8.

The asymmetric structure of the heat exchange plate may employ other structures. As shown in FIGS. 9 and 14, a fourth groove 171 that is recessed away from the first direction is provided between at least part of pairs of adjacent first protrusions 12, and a fourth protrusion 17 is formed on a back side of the fourth groove 171. The height of the first protrusion 12 relative to the first side surface 111 of the base plate 11 is greater than a height of the fourth protrusion 17 relative to the second side surface 112 of the base plate 11. The first protrusions 12 are wave-shaped protrusions, and the multiple wave-shaped protrusions are arranged along the length direction of the heat exchange plate 10. Each of the wave-shaped protrusions includes multiple extension sections 121, and each of the extension sections 121 is arranged obliquely relative to the length direction of the heat exchange plate 10. The fourth protrusion 17 is a wave-shaped protrusion, and the fourth protrusion 17 is provided between two adjacent first grooves 14.

Figure 16:
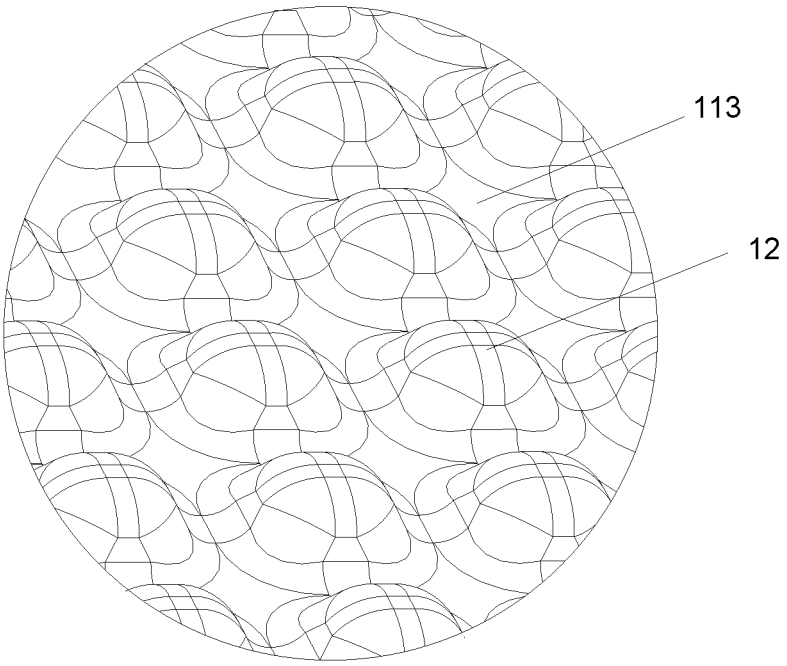
FIG. 16 is a schematic view of a partial structure of a heat exchange plate according to the present application.

It can be understood that the first protrusion 12 may also employ other structures such as a dotted wave in addition to the wave-shaped protrusion. As shown in FIG. 16, the dotted wave refers to that a pit is formed on the back side of the first protrusion 12, and the structure of the first protrusion 12, such as a circular protrusion, a polygonal pyramid protrusion, etc., corresponds to the structure of the pit. The heat exchange plate 10 is further provided with a recessed portion 113, and multiple first protrusions 12 are arranged around the recessed portion 113. The second protrusion 13 may employ other structures. The second protrusions 13 are closer to the two ends of the heat exchange plate 10 than the first protrusion 12, alternatively, the second protrusion 13 and the first protrusion 12 may be respectively arranged on two sides of the heat exchange plate 10 in the width direction or two sides of the heat exchange plate 10 in the length direction. The distribution of the first protrusion 12 and the second protrusion 13 may be adjusted according to the specific application requirements of the heat exchange plate 10.

Figure 6:
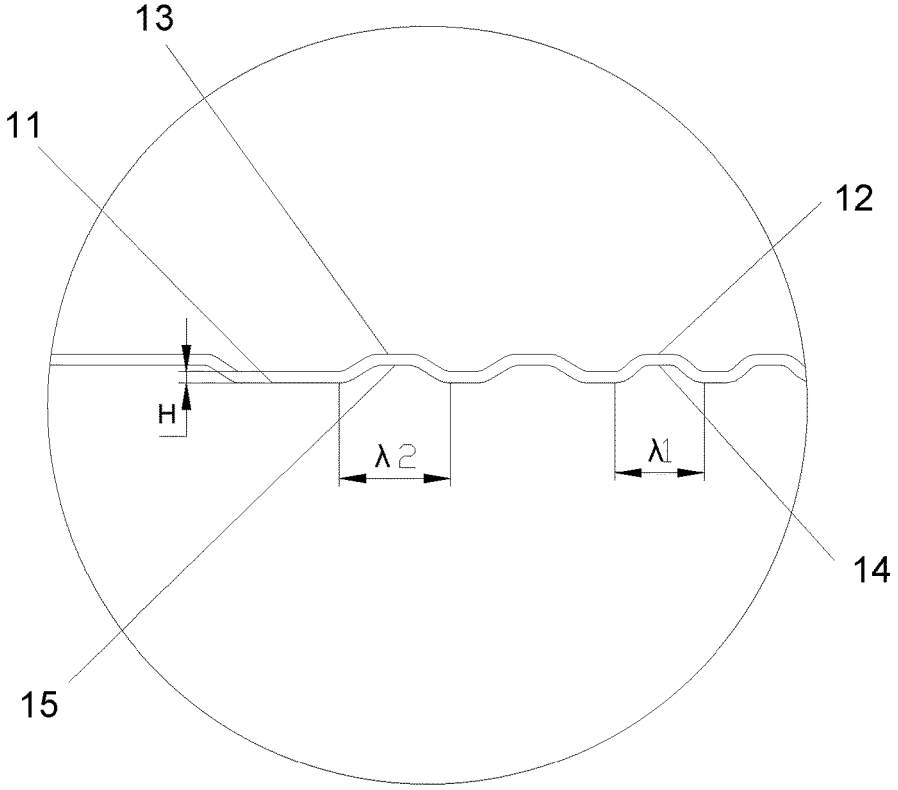
FIG. 6 is a schematic view showing the structure of an enlarged portion D in FIG. 5.
Figure 7:
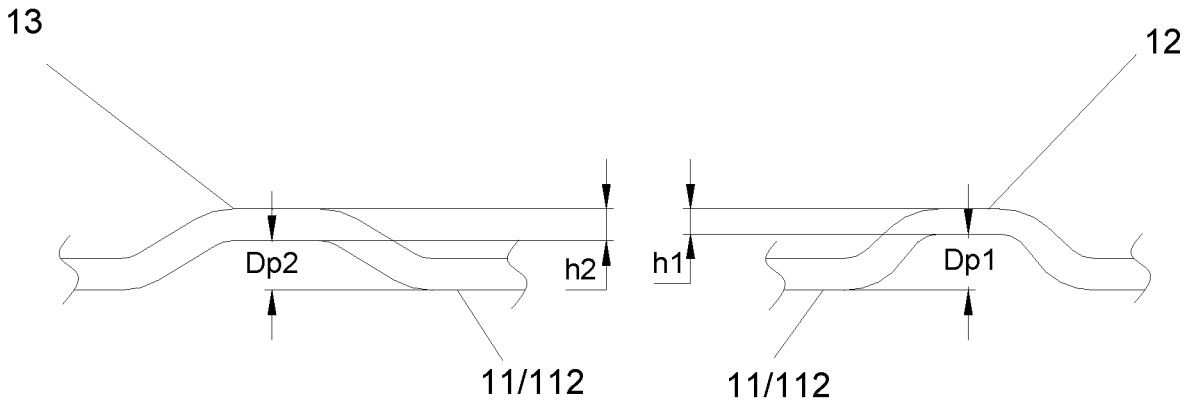
FIG. 7 is a view showing comparison between enlarged structures of a first protrusion and a second protrusion.

As shown in FIGS. 6 and 7, a thickness of the base plate 11 of the heat exchange plate 10 is H, the depth of the first groove 14 relative to the second side surface of the base plate 11 is Dp1, the depth of the second groove 15 relative to the second side surface of the base plate 11 is Dp2, the depth Dp1 of the first groove 14 relative to the second side surface of the base plate 11, the depth Dp2 of the second groove 15 relative to the second side surface of the base plate 11, and the thickness H of the base plate 11 meet the following relationship: $Dp2 \leq Dp1 \leq Dp2+2.8H$. Specifically, the thickness H of the base plate 11 ranges from 0.2 to 0.8 mm, the depth Dp1 of the first groove 14 is 0.9 mm, and the depth Dp2 of the second groove 15 is 0.85 mm. As the thinned degree of the material of the top of the protrusion is directly affected by the thickness of the heat exchange plate 10, the relationship $Dp2 \leq Dp1 \leq Dp2+2.8H$ is to be met, so that the depths of the first groove 14 and the second groove 15 can be reasonably adjusted based on the thickness of the heat exchange plate 10, to reduce the height difference between the top of the first protrusion 12 and the top of the second protrusion 13, which improves the flatness of the heat exchange plate 10. The flatness here means that tops of the protrusions of the heat exchange plate 10 are at a same height as much as possible, to control the height difference between the tops of the protrusions to be within a reasonable range.

In some specific embodiments, as shown in FIGS. 6, 7, 12 and 13, the maximum width λ1 of the orthographic projection of the first groove 14 on the plane where the second side surface 112 of the base plate 11 is located, the maximum width λ2 of the orthographic projection of the second groove 15 on the plane where the second side surface 112 of the base plate 11 is located, the depth Dp1 of the first groove 14 relative to the second side surface 112 of the base plate 11 and the depth Dp2 of the second groove 15 relative to the second side surface 112 of the base plate 11 meet the following relationship: $0.2 \leq (\lambda 1 \cdot DP2)/(\lambda 2 \cdot DP1) \leq 0.9$. Since the maximum width of the orthographic projection of the groove on the plane where the second side surface 112 of the base plate 11 is located directly affects the thinned degree of the material of the top of the protrusion, the smaller the maximum width of the orthographic projection of the groove on the plane where the second side surface 112 of the base plate 11 is located, the greater the deformation of the heat exchange plate 10 in the area where the groove is located, and the greater the thinned degree of the material of the top of the protrusion. Since $Dp1 > Dp2$, it can be understood that, when $\lambda 1 < \lambda 2$, the deformation of the heat exchange plate 10 in the area where the first groove 14 is located is greater than the deformation of the heat exchange plate 10 in the area where the second groove 15 is located. The relationship $0.2 \leq (\lambda 1 \cdot DP2)/(\lambda 2 \cdot DP1) \leq 0.9$ is to be met, so that the corresponding relationship between the depth of the first groove 14 and the depth of the second groove 15 can be adjusted according to the maximum widths of the orthographic projections of the first groove 14 and the second groove 15 on the plane where the second side surface 112 of the base plate 11 is located, to reduce the height difference between the top of the first protrusion 12 and the top of the second protrusion 13.

In some specific embodiments, the heat exchange plate 10 is an aluminum alloy plate, and the thickness H of the base plate 11 is generally about 0.4 to 0.5 mm. The maximum width λ1 of the orthographic projection of the first groove 14 on the plane where the second side surface 112 of the base plate 11 is located and the depth Dp1 of the first groove 14 relative to the second side surface 112 of the base plate 11 meet the following relationship: $2.5 \leq \lambda 1/DP1 \leq 5$, and the maximum width λ2 of the orthographic projection of the second groove 15 on the plane where the second side surface 112 of the base plate 11 is located and the depth Dp2 of the second groove 15 relative to the second side surface 112 of the base plate 11 meet the following relationship: $3.5 \leq \lambda 2/DP2 \leq 7$, so that the area where the first protrusion 12 is located has a good heat exchange performance, and the top of the second protrusion 13 has a sufficient thickness to ensure the strength of the heat exchange plate 10. Specifically, on one hand, the first protrusion 12 meets the technical requirement of $2.5 \leq \lambda 1/DP1 \leq 5$, and the heat exchange performance of the product is preferentially ensured in the area corresponding to the first protrusion 12. For example, the first protrusion 12 is provided in the heat exchange area 60 to preferentially ensure the heat exchange performance of the heat exchange area 60, that is, the superior material stretching design is realized through the first protrusion 12, which provides more heat exchange area and more detailed heat exchange space and structure. On the other hand, the second protrusion 13 meets the technical requirement of $3.5 \leq \lambda 2/DP2 \leq 7$, and the heat exchange performance and the reliability of the product are balanced in the area corresponding to the second protrusion 13. For example, the second protrusion 13 is provided in the corner hole area or the flow guide area between the corner hole area and the heat exchange area, through appropriate material stretching, the wall thickness of the fluid channel and the strength of the welded structure are ensured while the flow and the heat exchange requirements in the corresponding area are met. In addition, fluid distribution is preferentially embodied in terms of structural functions of the overall product in such areas, and the technical requirement of $3.5 \leq \lambda 2/DP2 \leq 7$ is also advantageous.

By providing the first protrusion 12 and the second protrusion 13 in the heat exchange plate 10, and making the first protrusion 12 and the second protrusion 13 meet the above parameter relationship, the heat exchanger 1 has the technical effects of superior heat exchange performance and reliable structure. On one hand, in the heat exchange area 60, the fluid channel corresponding to the second side surface of the base plate 11 has a denser and more uniform arrangement of solder-joints, which strengthens the heat exchange effect, improves the structure of the fluid channel, and especially suitable for an application scenario where a refrigerant is mainly taken into account. The first protrusion 12 and the second protrusion 13 meet the above parameter relationship, which is more beneficial to the uniformity of material molding. Logically, more material is required to be thinned to obtain a superior heat exchange performance, which requires that the heat exchange plate 10 is ensured to be uniformly molded during processing, to reduce the differences of maximum thinned amounts in different areas as much as possible, and thus avoiding local "short board" in the structure of product. After the heat exchange performance and material molding characteristics of the product are effectively explored, the present application seeks a "common benefit area" for the heat exchange performance and product strength on the premise of meeting the technical requirements. On the other hand, the two ends of the heat exchange plate 10 are key positions for the strength and fluid distribution of the heat exchanger 1. The corner hole area of the present application preferentially ensures strength and distribution, and the superior heat exchange performance and the reliable product structure are also considered.

Figure 13:
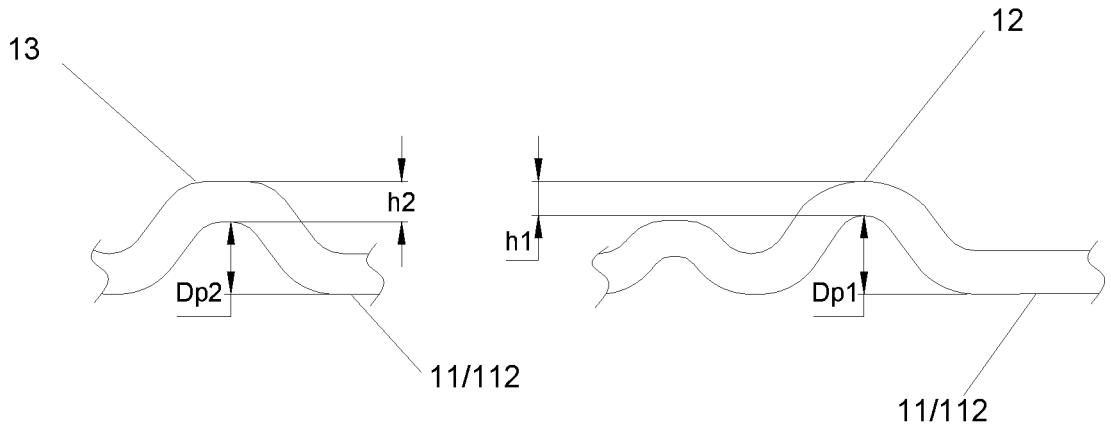
FIG. 13 is a view showing comparison between enlarged structures of a first protrusion and a second protrusion.

In some embodiments, as shown in FIGS. 7 and 13, a thickness of a protrusion top of the first protrusion 12 is h1, and a thickness of a protrusion top of the second protrusion 13 is h2. The depth Dp1 of the first groove 14 relative to the second side surface 112 of the base plate 11, the depth Dp2 of the second groove 15 relative to the second side surface 112 of the base plate 11, the thickness h1 of the protrusion top of the first protrusion 12 and the thickness h2 of the protrusion top of the second protrusion 13 meet the following relationship: $-0.05\ \text{mm} \leq (h1+DP1)-(h2+DP2) \leq 0.05$ mm, to make the top of the first protrusion 12 and the top of the second protrusion 13 to be substantially at a same height, that is, the top of the first protrusion 12 and the top of the second protrusion 13 are substantially in a same plane, to avoid pseudo soldering of the heat exchanger caused by the low heights of the tops of some protrusions. The height difference between the top of the first protrusion 12 and the top of the second protrusion 13 is controlled to be not greater than 0.05 mm, and the pseudo soldering of the heat exchanger may be easily avoided by means of solder filling, etc., thereby improving the overall performance of the heat exchanger. Specifically, the thickness h1 of the protrusion top of the first protrusion 12 is 0.4 mm, and the thickness h2 of the protrusion top of the second protrusion 13 ranges from 0.45 mm to 0.5 mm. In this case, $\lambda 1<\lambda 2$. The depth Dp1 of the first groove 14 relative to the second side surface 112 of the base plate 11 is 0.9 mm, and the depth Dp2 of the second groove 15 relative to the second side surface 112 of the base plate 11 ranges from 0.85 mm to 0.9 mm.

The heat exchanger provided by the present application has been introduced in detail above. Specific examples are used herein to illustrate the principles and implementations of the present application, and the descriptions of the embodiments are only used to help understand core ideas of the present application. It should be pointed out that for those skilled in the art, some improvements and modifications may be made to the present application without departing from the principles of the present application, and these improvements and modifications also fall within the protection scope of the claims of the present application.

The invention claimed is:

1. A heat exchanger, comprising a plurality of heat exchange plates arranged in a stacked manner, wherein each of the heat exchange plates comprises a base plate, a first protrusion and a second protrusion, a direction perpendicular to the base plate is defined as a first direction, both the first protrusion and the second protrusion protrude from the base plate towards the first direction, a first groove is formed on a back side of the first protrusion, a second groove is formed on a back side of the second protrusion, the base plate comprises two side surfaces, a side surface facing the first direction is defined as a first side surface, and a side surface facing away from the first direction is defined as a second side surface, wherein a thickness h1 of the first protrusion at a top thereof is smaller than a thickness h2 of the second protrusion at a top thereof, and a thickness of the first protrusion at an end portion thereof opposite to the top of the first protrusion in the first direction is equal to a thickness of the second protrusion at an end portion thereof opposite to the top of the second protrusion in the first direction, the thicknesses of the first protrusion and the second protrusion at the respective end portions being uniform;

a maximum width $\lambda 1$ of an orthographic projection of the first groove on a plane, where the second side surface of the base plate is located, is smaller than a maximum width $\lambda 2$ of an orthographic projection of the second groove on the plane, where the second side surface of the base plate is located; and a height difference between the top of the first protrusion and the top of the second protrusion in the first direction is less than or equal to 0.05 mm.

2. The heat exchanger according to claim 1, wherein a thickness of the base plate is H, a depth Dp1 of the first groove relative to the second side surface of the base plate, a depth Dp2 of the second groove relative to the second side surface of the base plate, and the thickness H of the base plate meet the following relationship: $Dp2<Dp1<Dp2+2.8H$.

3. The heat exchanger according to claim 2, wherein the maximum width $\lambda 1$ of the orthographic projection of the first groove on the plane where the second side surface of the base plate is located, the maximum width $\lambda 2$ of the orthographic projection of the second groove on the plane where the second side surface of the base plate is located, the depth Dp1 of the first groove relative to the second side surface of the base plate and the depth Dp2 of the second groove relative to the second side surface of the base plate meet the following relationship: $0.2 \leq (\lambda 1 \cdot Dp2)/(\lambda 2 \cdot Dp1) \leq 0.9$.

4. The heat exchanger according to claim 3, wherein the maximum width $\lambda 1$ of the orthographic projection of the first groove on the plane where the second side surface of the base plate is located and the depth Dp1 of the first groove relative to the second side surface of the base plate meet the following relationship: $2.5 \leq \lambda 1/Dp1 \leq 5$; and the maximum width $\lambda 2$ of the orthographic projection of the second groove on the plane where the second side surface of the base plate is located and the depth Dp2 of the second groove relative to the second side surface of the base plate meet the following relationship: $3.5 \leq \lambda 2/Dp2 \leq 7$.

5. The heat exchanger according to claim 1, wherein the heat exchange plate comprises a first corner hole area, a second corner hole area and a heat exchange area, along a length direction of the heat exchange plate, the heat exchange plate comprises a first end and a second end, wherein the first corner hole area is close to the first end of the heat exchange plate, the second corner hole area is close to the second end of the heat exchange plate, the heat exchange area is located between the first corner hole area and the second corner hole area, a first flow guide area is provided between the first corner hole area and the heat exchange area, a second flow guide area is provided between the second corner hole area and the heat exchange area, the first protrusion is provided in the heat exchange area, and the second protrusion is provided in the first flow guide area and/or the second flow guide area; and/or, along a width direction of the heat exchange plate, the first corner hole area is provided with a first corner hole and a second corner hole, and the second corner hole area is provided with a third corner hole and a fourth corner hole, wherein the second protrusion is provided between the first corner hole and the second corner hole, and/or, the second protrusion is provided between the third corner hole and the fourth corner hole.

6. The heat exchanger according to claim 5, wherein the heat exchange plate is further provided with a plurality of protruding parts protruding towards the first direction;

the protruding parts are respectively arranged around an edge of the first corner hole and an edge of the third corner hole, and the first corner hole and the third corner hole are each provided at a top of the corresponding protruding part; and/or, the protruding parts are arranged at outer peripheries of the second corner hole and the fourth corner hole, and predetermined distances are respectively provided between the second corner hole and the corresponding protruding part, and between the fourth corner hole and the corresponding protruding part;

along the width direction of the heat exchange plate, the first corner hole and the third corner hole are arranged on a same side of the heat exchange plate, or the first corner hole and the third corner hole are arranged on two sides of the heat exchange plate; and a back side of the top of the first protrusion has a first flat part, a back side of the top of the second protrusion has a second flat part, a back side of a top of each of the protruding parts has a third flat part, wherein a width Wb1 of the first flat part, a width Wb2 of the second flat part, and a width Wb3 of the third flat part meet the following relationship: $Wb1 \leq Wb2 < Wb3$.

7. The heat exchanger according to claim 1, wherein the first protrusion is a wave-shaped protrusion, a plurality of the wave-shaped protrusions are provided along a length direction of the heat exchange plate, a first recess is formed between two adjacent wave-shaped protrusions, each of the wave-shaped protrusions comprises a plurality of extension sections, and the plurality of extension sections are arranged obliquely relative to the length direction of the heat exchange plate.

8. The heat exchanger according to claim 1, wherein a third protrusion protruding towards the first direction is provided between at least part of pairs of adjacent first protrusions, a third groove is formed on a back side of the third protrusion, and a height of the third protrusion relative to the first side surface of the base plate is smaller than a height of the first protrusion relative to the first side surface of the base plate; and the first protrusion is a wave-shaped protrusion, a plurality of the wave-shaped protrusions are provided along a length direction of the heat exchange plate, each of the wave-shaped protrusions comprises a plurality of extension sections, the plurality of extension sections are arranged obliquely relative to the length direction of the heat exchange plate, the third protrusion is a wave-shaped protrusion, and a second recess is formed between the third protrusion and the corresponding first protrusion which are adjacent to each other.

9. The heat exchanger according to claim 1, wherein a fourth groove that is recessed away from the first direction is provided between at least part of pairs of adjacent first protrusions, a fourth protrusion is formed on a back side of the fourth groove, a height of the first protrusion relative to the first side surface of the base plate is greater than a height of the fourth protrusion relative to the second side surface of the base plate; and the first protrusion is a wave-shaped protrusion, a plurality of the wave-shaped protrusions are provided along a length direction of the heat exchange plate, each of the wave-shaped protrusions comprises a plurality of extension sections, the plurality of extension sections are arranged obliquely relative to the length direction of the heat exchange plate, the fourth protrusion is a wave-shaped protrusion, and the fourth protrusion is provided between two adjacent first grooves.

10. The heat exchanger according to claim 1, wherein the heat exchange plate comprises a first corner hole area, a second corner hole area and a heat exchange area, along a length direction of the heat exchange plate, the heat exchange plate comprises a first end and a second end, wherein the first corner hole area is close to the first end of the heat exchange plate, the second corner hole area is close to the second end of the heat exchange plate, the heat exchange area is located between the first corner hole area and the second corner hole area, the first protrusion is provided in the heat exchange area, the first groove is a pit structure, the heat exchange area is further provided with a recessed portion, and a plurality of the first protrusions are arranged around the recessed portion.

11. The heat exchanger according to claim 2, wherein the heat exchange plate comprises a first corner hole area, a second corner hole area and a heat exchange area, along a length direction of the heat exchange plate, the heat exchange plate comprises a first end and a second end, wherein the first corner hole area is close to the first end of the heat exchange plate, the second corner hole area is close to the second end of the heat exchange plate, the heat exchange area is located between the first corner hole area and the second corner hole area, a first flow guide area is provided between the first corner hole area and the heat exchange area, a second flow guide area is provided between the second corner hole area and the heat exchange area, the first protrusion is provided in the heat exchange area, and the second protrusion is provided in the first flow guide area and/or the second flow guide area; and/or, along a width direction of the heat exchange plate, the first corner hole area is provided with a first corner hole and a second corner hole, and the second corner hole area is provided with a third corner hole and a fourth corner hole, wherein the second protrusion is provided between the first corner hole and the second corner hole, and/or, the second protrusion is provided between the third corner hole and the fourth corner hole.

12. The heat exchanger according to claim 2, wherein the first protrusion is a wave-shaped protrusion, a plurality of the wave-shaped protrusions are provided along a length direction of the heat exchange plate, a first recess is formed between two adjacent wave-shaped protrusions, each of the wave-shaped protrusions comprises a plurality of extension sections, and the plurality of extension sections are arranged obliquely relative to the length direction of the heat exchange plate.

13. The heat exchanger according to claim 3, wherein the first protrusion is a wave-shaped protrusion, a plurality of the wave-shaped protrusions are provided along a length direction of the heat exchange plate, a first recess is formed between two adjacent wave-shaped protrusions, each of the wave-shaped protrusions comprises a plurality of extension sections, and the plurality of extension sections are arranged obliquely relative to the length direction of the heat exchange plate.

14. The heat exchanger according to claim 4, wherein the first protrusion is a wave-shaped protrusion, a plurality of the wave-shaped protrusions are provided along a length direction of the heat exchange plate, a first recess is formed between two adjacent wave-shaped protrusions, each of the wave-shaped protrusions comprises a plurality of extension sections, and the plurality of extension sections are arranged obliquely relative to the length direction of the heat exchange plate.

15. The heat exchanger according to claim 2, wherein a third protrusion protruding towards the first direction is provided between at least part of pairs of adjacent first protrusions, a third groove is formed on a back side of the third protrusion, and a height of the third protrusion relative to the first side surface of the base plate is smaller than a height of the first protrusion relative to the first side surface of the base plate; and the first protrusion is a wave-shaped protrusion, a plurality of the wave-shaped protrusions are provided along a length direction of the heat exchange plate, each of the wave-shaped protrusions comprises a plurality of extension sections, the plurality of extension sections are arranged obliquely relative to the length direction of the heat exchange plate, the third protrusion is a wave-shaped protrusion, and a second recess is formed between the third protrusion and the corresponding first protrusion which are adjacent to each other.

16. The heat exchanger according to claim 2, wherein the heat exchange plate comprises a first corner hole area, a second corner hole area and a heat exchange area, along a length direction of the heat exchange plate, the heat exchange plate comprises a first end and a second end, wherein the first corner hole area is close to the first end of the heat exchange plate, the second corner hole area is close to the second end of the heat exchange plate, the heat exchange area is located between the first corner hole area and the second corner hole area, the first protrusion is provided in the heat exchange area, the first groove is a pit structure, the heat exchange area is further provided with a recessed portion, and a plurality of the first protrusions are arranged around the recessed portion.

17. The heat exchanger according to claim 3, wherein the heat exchange plate comprises a first corner hole area, a second corner hole area and a heat exchange area, along a length direction of the heat exchange plate, the heat exchange plate comprises a first end and a second end, wherein the first corner hole area is close to the first end of the heat exchange plate, the second corner hole area is close to the second end of the heat exchange plate, the heat exchange area is located between the first corner hole area and the second corner hole area, the first protrusion is provided in the heat exchange area, the first groove is a pit structure, the heat exchange area is further provided with a recessed portion, and a plurality of the first protrusions are arranged around the recessed portion.

18. The heat exchanger according to claim 1, wherein the heat exchange plate is provided with a first corner hole and a third corner hole respectively located close to opposite ends of the heat exchange plate in a length direction of the heat exchange plate;

the heat exchange plate further comprises protruding parts protruding from the base plate towards the first direction, the protruding parts respectively surround the first corner hole and the third corner hole, and the first corner hole and the third corner hole are each provided at a top of the corresponding protruding part; and a back side of the top of the first protrusion has a first flat part, a back side of the top of the second protrusion has a second flat part, a back side of a top of each of the protruding parts has a third flat part, wherein a width Wb1 of the first flat part, a width Wb2 of the second flat part, and a width Wb3 of the third flat part meet the following relationship: $Wb1 \leq Wb2 < Wb3$.

19. The heat exchanger according to claim 1, wherein the heat exchange plate is provided with a second corner hole and a fourth corner hole respectively located close to opposite ends of the heat exchange plate in a length direction of the heat exchange plate;

the heat exchange plate further comprises protruding parts protruding from the base plate towards the first direction, the protruding parts are respectively arranged at outer peripheries of the second corner hole and the fourth corner hole, and predetermined distances are respectively provided between the second corner hole and the corresponding protruding part, and between the fourth corner hole and the corresponding protruding part; and a back side of the top of the first protrusion has a first flat part, a back side of the top of the second protrusion has a second flat part, a back side of a top of each of the protruding parts has a third flat part, wherein a width Wb1 of the first flat part, a width Wb2 of the second flat part, and a width Wb3 of the third flat part meet the following relationship: $Wb1 \leq Wb2 < Wb3$.

20. The heat exchanger according to claim 1, wherein the heat exchange plate is provided with a first corner hole, a second corner hole, a third corner hole, and a fourth corner hole respectively located close to four corners of the heat exchange plate, and the heat exchange plate further comprises first protruding parts and second protruding parts protruding from the base plate towards the first direction;

the first protruding parts respectively surround the first corner hole and the third corner hole, and the first corner hole and the third corner hole are each provided at a top of the corresponding first protruding part;

the second protruding parts are respectively arranged at outer peripheries of the second corner hole and the fourth corner hole, and predetermined distances are respectively provided between the second corner hole and the corresponding second protruding part, and between the fourth corner hole and the corresponding second protruding part, wherein the first protruding parts are located at one side of the heat exchange plate in a width direction of the heat exchange plate, and the second protruding parts are located at the other side of the heat exchange plate in the width direction of the heat exchange plate; or the first protruding parts are arranged diagonally opposite to each other on the heat exchange plate, and the second protruding parts are arranged diagonally opposite to each other on the heat exchange plate.

* * * * *